United States Patent [19]

Ungarean et al.

[11] Patent Number: 4,473,104

[45] Date of Patent: Sep. 25, 1984

[54] ELECTROMAGNETIC CASTING PROCESS AND APPARATUS

[75] Inventors: Gary L. Ungarean, Woodbridge; John C. Yarwood, Madison, both of Conn.

[73] Assignee: Olin Corporation, New Haven, Conn.

[21] Appl. No.: 350,846

[22] Filed: Feb. 22, 1982

Related U.S. Application Data

[63] Continuation of Ser. No. 110,893, Jan. 10, 1980, abandoned.

[51] Int. Cl.[3] ..... B22D 27/02

[52] U.S. Cl. ..... 164/453; 164/467; 164/504; 164/155

[58] Field of Search ..... 164/453, 467, 504, 155

[56] References Cited

U.S. PATENT DOCUMENTS

| | | | |
|---|---|---|---|
| 3,467,166 | 9/1969 | Getselev et al. | 164/49 |
| 3,605,865 | 9/1971 | Getselev . | |
| 3,646,988 | 3/1972 | Getselev . | |
| 3,702,155 | 11/1972 | Getselev . | |
| 3,735,799 | 5/1973 | Karlson . | |
| 3,741,280 | 6/1973 | Kozheurov et al. . | |
| 3,773,101 | 11/1973 | Getselev . | |
| 3,985,179 | 10/1976 | Goodrich et al. . | |
| 4,004,631 | 1/1977 | Goodrich et al. . | |
| 4,014,379 | 3/1977 | Getselev | 164/4 |
| 4,161,206 | 7/1979 | Yarwood et al. | 164/49 |
| 4,161,978 | 7/1979 | Brooks et al. . | |
| 4,202,398 | 5/1980 | Osugi | 164/150 |
| 4,212,342 | 7/1980 | Linder et al. | 164/4 |
| 4,226,278 | 10/1980 | Osugi | 164/449 |

FOREIGN PATENT DOCUMENTS

| | | |
|---|---|---|
| 273226 | 10/1970 | U.S.S.R. . |
| 338297 | 6/1972 | U.S.S.R. . |
| 537750 | 3/1977 | U.S.S.R. . |

OTHER PUBLICATIONS

"Alusuisse Experience with Electromagnetic Moulds", by H. A. Meier, G. B. Leconte & A. M. Odok, Light Metals, 1977, pp. 223–233.

"Formation of Ingot Surface During Continuous Casting", by G. A. Balakhontsev et al., Tsvetnye Met., Aug. 1970, 43, p. 64.

"Continuous Casting with Formation of Ingot by Electromagnetic Field", by P. P. Mochalov and Z. N. Getselev, Tsvetnye Met., Aug. 1970, 43, pp. 62–63.

"Casting in an Electromagnetic Field", by Z. N. Getselev, J. of Metals, Oct. 1971, pp. 38–59.

*Primary Examiner*—Kuang Y. Lin

*Attorney, Agent, or Firm*—Paul Weinstein

[57] ABSTRACT

An apparatus or process for casting metals by electromagnetically forming molten metal into a desired shape by applying a magnetic field to the molten metal. The magnetic field defines a containment zone for the molten metal. The hydrostatic pressure exerted by the molten metal in the containment zone is sensed and in response thereto the flow of molten metal into the containment zone is controlled. This minimizes changes in the hydrostatic pressure.

20 Claims, 3 Drawing Figures

ELECTROMAGNETIC CASTING PROCESS AND APPARATUS

This application is a continuation of application Ser. No. 110,893, filed Jan. 10, 1980, abandoned.

BACKGROUND OF THE INVENTION

This invention relates to an improved process and apparatus for electromagnetically casting metals and alloys. The electromagnetic casting process has been known and used for many years for continuously and semi-continuously casting metals and alloys. The process has been employed commercially for casting aluminum and aluminum alloys.

PRIOR ART STATEMENT

The electromagnetic casting apparatus comprises a three part mold consisting of an inductor, a non-magnetic screen and a manifold for applying cooling water to the ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

A large body of prior art relating to various aspects of the electromagnetic casting process and apparatus is described in the prior art statement of U.S. Pat. No. 4,161,206 and, therefore, will not be repeated here.

The present invention is particularly related to the process and apparatus for controlling the electromagnetic casting system. Various approaches have been described in the prior art for controlling the excitation of the inductor in a manner so as to provide ingots of uniform cross section. In U.S. Pat. No. 4,014,379 to Getselev a control system is described for controlling the current flowing through the inductor responsive to deviations in the dimensions of the liquid zone (molten metal head) of the ingot from a prescribed value. In Getselev, U.S. Pat. No. 4,014,379 the inductor voltage is controlled to regulate the inductor current in response to measured variations in the level of the surface of the liquid zone of the ingot. Control of the inductor voltage is achieved by an amplified error signal applied to the field winding of a frequency changer.

In Russian Pat. No. 537,750 to Getselev an alternative control approach is described wherein the potential on the inductor is regulated to reduce a deviation of the phase angle from a programmed value.

In U.S. Pat. No. 4,161,206 to Yarwood et al. a control system for electromagnetic casting is utilized for minimizing variations in the gap between the molten metal and the inductor. In this approach a reactive electrical parameter of the inductor which varies with the magnitude of the gap is determined and compared to reference values to generate an error signal for controlling the inductor excitation.

In Russian Pat. No. 273,226 to Kabakov there is disclosed a control system for controlling the metal level in the electromagnetic casting mold. A metal level measuring coil has a relay connected to the ingot withdrawal mechanism via a regulator. At the start of casting the withdrawal mechanism is in its initial position. The regulator is connected to an actuator which starts the feed of metal into the mold. When the metal level reaches the height of the sensing coil, a signal is transmitted to the regulator which throws the relay and operates the withdrawal mechanism to withdraw the ingot from the mold.

In Russian Pat. No. 338,297 to Irkutsk the electromagnetic casting mold is fitted with measuring coils to control the metal level in the mold. The amount of metal flowing into the mold is controlled by a value compounded with an actuator. No description is given in this patent of any automated feedback of the sensed signal from the coil to the actuator. In fact, the actuator appears to be manually operated.

The approaches for controlling molten metal head described in the Russian patents to Kabakov and Irkutsk are deficient in that control is based solely on the sensed upper level of the molten metal head. Therefore, these control systems do not take into account changes in the molten metal head due to fluctuations in the position of the solid liquid interface between the molten metal and the solidified casting. These changes in the interface position occur because of instabilities in the withdrawal mechanism, instabilities in the coolant application system, etc. The result of increasing or reducing the height of the molten metal head whether due to a repositioning of the solid liquid interface or the upper surface of the molten metal or both is to increase or decrease, respectively, the hydrostatic pressure exerted by the molten metal head. These changes in hydrostatic pressure must be offset by the control system for controlling the excitation of the inductor.

The system described in Yarwood et al. has been shown to be effective for providing solidified castings of more uniform cross section by overcoming the instabilities associated with changes in hydrostatic pressure of the molten metal head. It is, of course, desirable that any control system for controlling the inductor excitation operate over its most preferred range of control. Therefore, it is highly undesirable to have any long term changes in hydrostatic pressure due to changes in the height of the molten metal head. Consequently, it has been found desirable to provide some control in addition to the electrical control of the inductor excitation which could reduce the variation in molten metal head height during a casting run.

SUMMARY OF THE INVENTION

In accordance with the present invention, a process and apparatus is provided for controlling the molten metal head height during a casting run. The system of this invention does not require actual measurement of the position of the liquid-solid interface or the top surface of the molten metal. Rather, it relies upon the sensing of an electrical parameter or signal from the inductor excitation and control system which changes as the hydrostatic pressure of the molten metal head changes. The electrical signal which is sensed as above is applied to a controller which adjusts the flow of molten metal into the mold in response thereto.

In particular, the present invention is directed to a process and apparatus for casting metals by electromagnetically forming molten metal into a desired casting shape. The electromagnetic forming is accomplished by means of an inductor which applies a magnetic field to the molten metal. The magnetic field serves to define a containment zone for the molten metal. A system is provided for controlling and applying an alternating current to the inductor to generate the magnetic field.

In accordance with this invention, the aforenoted apparatus is improved by providing a system for controlling the hydrostatic pressure exerted by the molten metal in the containment zone. This is accomplished by sensing an electrical signal derived from the system for controlling and applying the alternating current to the inductor. The electrical signal which is sensed is one which changes in correspondence to changes in the hydrostatic pressure of the molten metal in the containment zone. In response to the sensed electrical signal, the flow rate of molten metal into the containment zone is controlled.

The electrical signal which is sensed may comprise any of a number of possible signals including but not limited to: the error signal which is applied to the power supply to control the inductor excitation; or any of the voltage frequency or current signals applied to the inductor; or internal signals applied within the power supply such as bus voltage control signals. The sole criteria for selecting the appropriate signal is that it be one which varies in correspondence with a variation in the hydrostatic pressure of the molten metal head.

Accordingly, it is an object of this invention to reduce the variation in hydrostatic pressure exerted by the molten metal in the containment zone of an electromagnetic casting system.

It is a further object of this invention to accomplish this result without the necessity of sensing either the height of the molten metal head or the interface between the molten metal and the solidifying casting.

These and other objects will become more apparent from the following description and drawings.

DETAILED DESCRIPTION OF PREFERRED EMBODIMENTS

Figure 1:
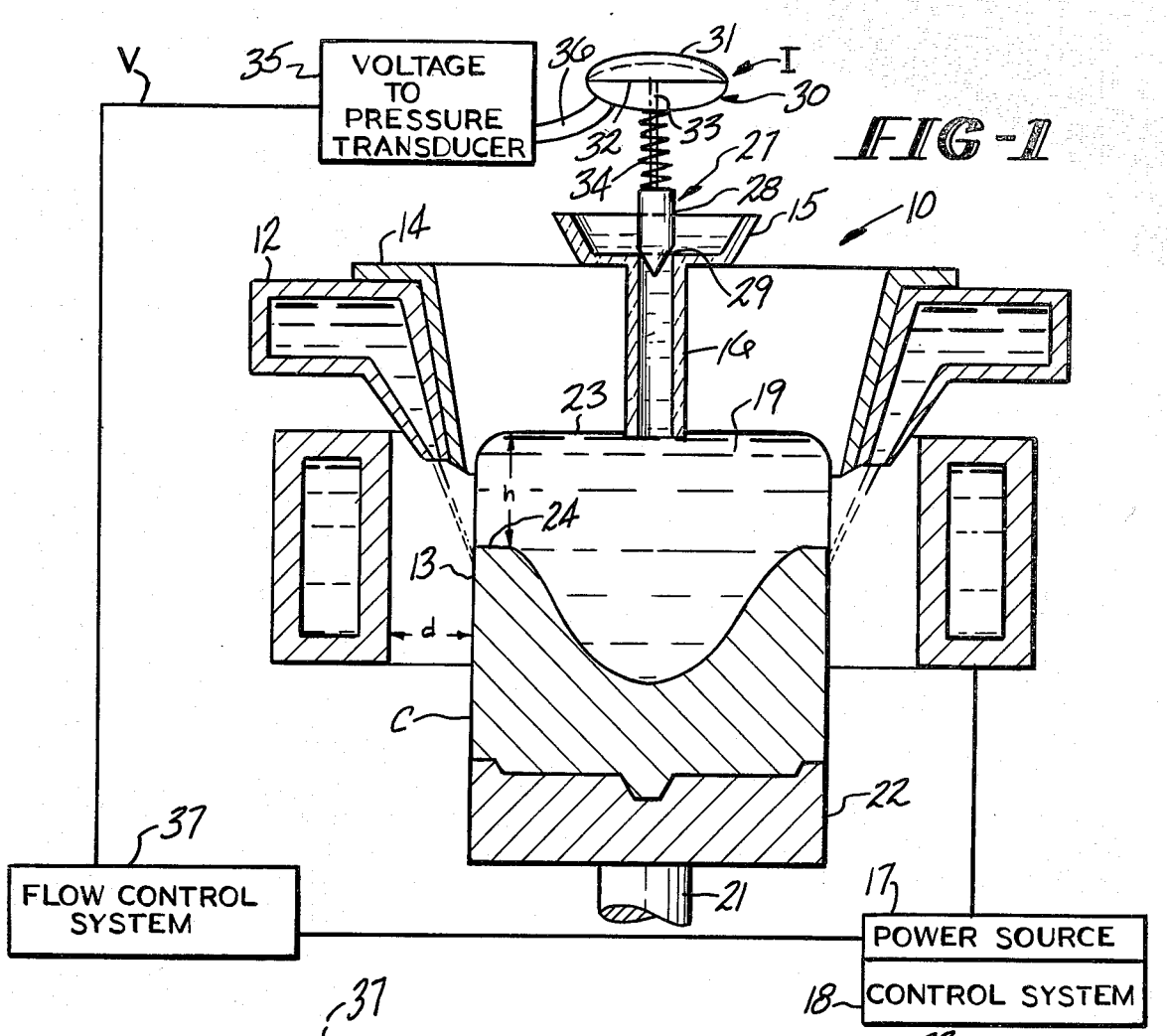
FIG. 1 is a schematic representation of an electromagnetic casting apparatus in accordance with the present invention.

Referring now to FIG. 1, there is shown by way of example an electromagnetic casting apparatus of this invention.

The electromagnetic casting mold 10 is comprised of an inductor 11 which is water cooled; a cooling manifold 12 for applying cooling water to the peripheral surface 13 of the metal being cast C; and a non-magnetic screen 14. Molten metal is continuously introduced into the mold 10 during a casting run using a trough 15 and down spout 16 and molten metal head control I in accordance with this invention. The inductor 11 is excited by an alternating current from a power source 17 and control system 18 which preferably is of the type described in the aforenoted Yarwood et al. U.S. Pat. No. 4,161,206.

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it in the zone defined by the magnetic field so that it solidifies in a desired ingot C cross section.

An air gap d exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic screen 14 is to fine tune and balance the magnetic pressure with the hydrostatic pressure of the molten metal head 19. The non-magnetic screen 14 may comprise a separate element as shown or may, if desired, be incorporated as a unitary part of the manifold for applying the coolant.

Initially, a conventional ram 21 and bottom block 22 is held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the ingot surface 13. In the embodiment which is shown in FIG. 1 the water is applied to the ingot surface 13 within the confines of the inductor 11. The water may be applied to the ingot surface 13 above, within or below the inductor 11 as desired.

If desired any of the prior art mold constructions or other known arrangements of the electromagnetic casting apparatus as described in the Background of the Invention could be employed.

The present invention is concerned with the control of the casting process and apparatus in order to provide cast ingots C, which have a substantially uniform cross section over the length of the ingot and which are formed of metals and alloys such as copper and copper base alloys. This is accomplished in accordance with the present invention by controlling the molten metal head in the casting zone so as to maintain a substantially uniform hydrostatic pressure. The molten metal head 19 corresponds to the pool of molten metal arranged above the solidifying ingot C which exerts the aforenoted hydrostatic pressure in the magnetic containment zone. In a vertical casting apparatus 10 as in FIG. 1, the molten metal head 19 extends from the top surface 23 of the molten metal pool to the solid/liquid interface or solidification front 24 and further includes a limited contribution associated with the molten metal in and above the down spout 16.

In the prior art as noted in the background of this application, various systems have been described with the aim of providing cast ingots by the electromagnetic casting process which have substantially uniform cross sections. In these approaches the excitation of the inductor 11 is controlled in a way so as to compensate for any variations in the molten metal head 19 in order to maintain uniform dimensions in the cast ingot. The approach suggested in U.S. Pat. No. 4,161,206 to Yarwood et al. is particularly preferred in accordance with the present invention and has been found to provide ingots of substantially uniform cross section.

With any of these approaches some parameter of the casting process or system 10 is sensed in order to generate an error signal which is applied to the power supply 17 which excites the inductor 11 in order to control the inductor current in a way so as to overcome variations in the hydrostatic pressure of the molten metal head 19. Any such control system will optimally operate at peak efficiency over a given range of such a sensed parameter. In any casting apparatus, however, there can be trends or changes which can shift the range of the sensed parameter over a period of time adversely with respect to its optimum control range.

Therefore, in accordance with this invention longer term changes in the molten metal head 19, and more particularly the hydrostatic pressure exerted by the molten metal head, are overcome by controlling the flow of the molten metal into the containment zone so as to maintain the hydrostatic pressure within desired limits. This should enable the control system 18 for the excitation of the inductor 11 to operate within its optimum ranges of control and should also reduce the instabilities associated with changes in hydrostatic pressure of the system, particularly long term instabilities.

The prior art control systems for controlling the excitation of the inductor 11 even if effective for their purposes are not effective for preventing long term changes in hydrostatic pressure associated with the molten metal head 19. The two Russian patents to Getselev described in the background of this application utilize sensing coils for sensing metal head height and attempt to control the flow of molten metal into the containment zone. These approaches take into account only changes in the hydrostatic pressure associated with changes in the top surface 23 of the molten metal head 19.

In contrast to the approaches adopted by Getselev, the present invention is directed to an integrated approach. Instead of sensing head height of the molten metal head 19, an electrical parameter is sensed which is derived from the control and/or current application system 17, 18 of the apparatus 10. The means for controlling and exciting the inductor 11 can comprise a separate power supply 17 and electrical control system 18 as shown, or they could be combined in a single unit. For purposes of the present invention, the signal which is sensed can be derived from either the control portion 18 or the power source portion 17 of the control and current application means. The electrical signal which is sensed is one which varies generally proportionally with changes in hydrostatic pressure of the molten metal head 19. Therefore, changes in the signal correspond to changes in the hydrostatic pressure. By determining or sensing a parameter indicative of hydrostatic pressure as opposed to head height alone, it is an advantage of the present invention that changes in the position of the liquid-solid interface 24 between the solidifying casting C and the molten metal pool 19 are also taken into account. This is something that the prior art systems have not provided for.

In accordance with this invention, it is presumed that the control system 18 is effective for providing a cast ingot of substantially uniform diameter. Most control systems 18 operate in one way or another by generating an error signal which is applied to the power supply 17 in order to change its output in a direction which will counteract the effect of changing hydrostatic pressure of the molten metal head 19. The flow rate of molten metal into the containment zone cannot be controlled so precisely so as to avoid instability or other variations in the molten metal head 19 and its resultant hydrostatic pressure.

Figure 2:
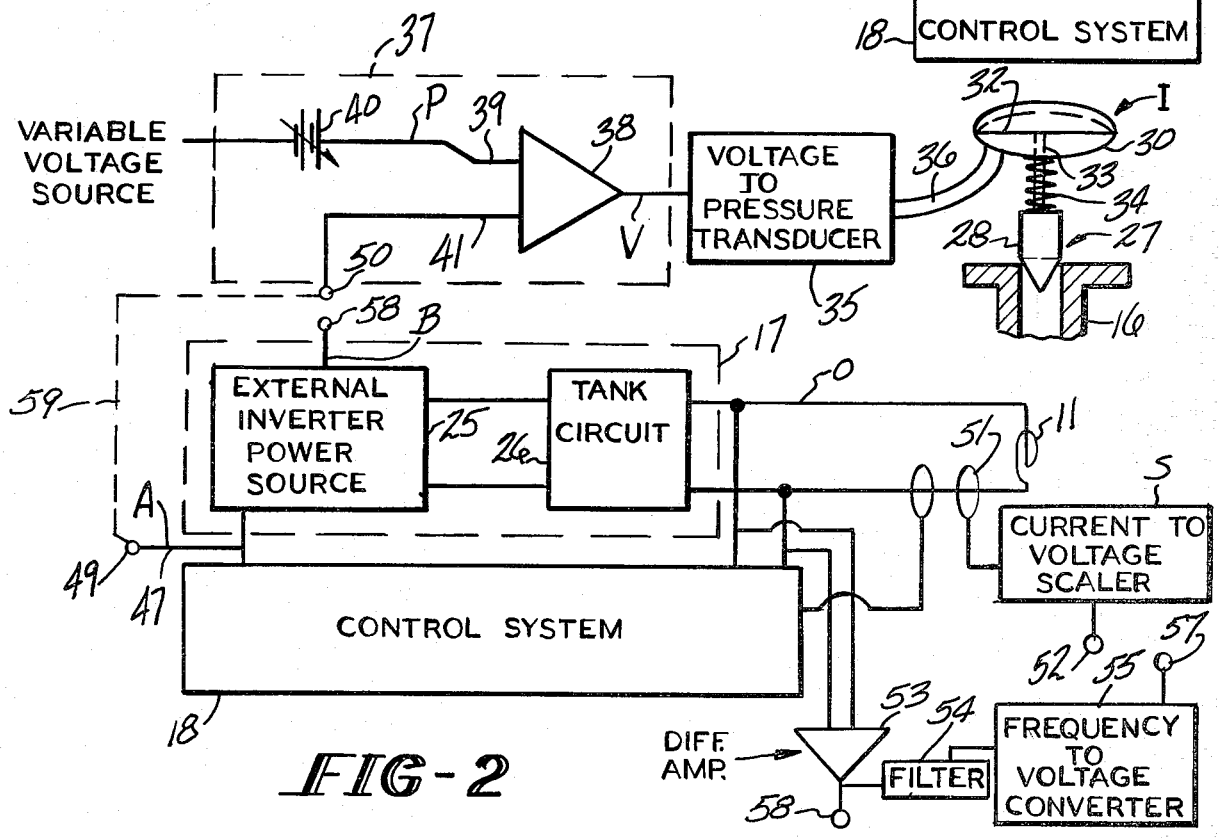
FIG. 2 is a partial schematic representation of an electromagnetic casting apparatus showing further details of the molten metal hydrostatic pressure control system.

Referring now to FIGS. 1 and 2, control system 18 operates with relatively short control cycles so that the ingot C diameter never changes substantially. Therefore, the error signal A as in FIG. 2, which is generated by the control system 18 for application to the power supply 17, is one signal which corresponds to changes in hydrostatic pressure of the molten metal head 19. The error signal A may take any desired form, for example, it could be a current, voltage, frequency, etc. Preferably, in accordance with this invention, the error signal A is a voltage signal which is applied to an appropriate control input of the power supply 17 to control the output thereof.

Preferably, in accordance with this invention the power supply 17 comprises a solid state power supply as are known in the art, although a motor generator could be utilized if desired. In such a solid state power supply 17 various internal signals B result from the application of the error signal A to the control input of the supply. For example, in a solid state power supply 17 where an incoming AC voltage is rectified to a DC voltage which is then chopped to regulate the voltage and then inverted to provide an AC output of the desired frequency and voltage, a bus voltage which is used to control the voltage output of the supply 17 is a signal B which corresponds to the error signal A and, therefore, to changes in hydrostatic pressure. Similarly, various other signals B could be extracted from the power supply 17 at any point from the error signal A input to the output of the supply so long as they correspond to changes associated with the error signal and, therefore, changes in hydrostatic pressure. Finally, the output signals O of the power supply 17 which are applied to the inductor 11 and which correspond to changes in hydrostatic pressure can be used. This applies, of course, only to those output signals O which are varied in response to changes in error signal A. In the apparatus of this invention one such output signal O would be the current in the inductor 11. Alternatively, the voltage applied to the inductor 11 or in a variable frequency supply 17 the frequency could be sensed.

The present apparatus 10 is preferably directed to an arrangement wherein the frequency is fixed and only the voltage and current on the inductor 11 is varied. However, if desired, power supplies wherein the frequency is not fixed could be employed and thereby changes in frequency could be utilized as a signal O. It is apparent from the foregoing that the signal which is sensed A, B, or O as desired in accordance with this invention to determine changes in hydrostatic pressure can be derived from either the control system 18 or the power supply 17 for exciting the inductor 11.

Referring again to the apparatus of FIGS. 1 and 2, the inductor 11 is connected to an electrical power source or supply 17 which provides the necessary controlled current and voltage at a desired frequency. A typical power supply circuit may be considered as two subcircuits 25 and 26. An external circuit 25 consists essentially of a solid state generator providing an electrical potential across the load or tank circuit 26 which includes the inductor 11. This latter circuit 26 except for the inductor 11 is sometimes referred to as a heat station and includes elements such as capacitors and transformers.

In accordance with this invention, the generator circuit 25 is preferably a solid state inverter. A solid state inverter is preferred because it is possible to provide a selectable frequency output over a range of frequencies. This in turn makes it possible to control the penetration depth of the current in the load. Both the solid state inverter 25 and the tank circuit or heat station 26 may be of conventional design. Preferably, the power supply is provided with front end DC voltage control in order to separate the voltage and frequency functions of the supply.

The control system 18 may be of any desired design including any of these described in the background of this application. However, preferably it is a system in accordance with the U.S. Pat. No. 4,161,206, Yarwood et al. In that system a reactive parameter of the inductor is sensed which is a function of the gap "d" between the molten metal 19 and the inductor 11. The sensed parameter is compared with a preset value thereof and an error signal A is generated which is a function of the difference between the magnitude of the sensed parameter and a preset value thereof. As the sensed parameter changes, so does the error signal A in correspondence thereto. If the sensed parameter corresponds about to inductance, as in the preferred approach of the Yarwood et al. patent, then the control system 18 is adapted to control the power supply 17 in a way so as to maintain a substantially constant inductance and thereby a substantially uniform ingot cross section.

The changes in the value of the error signal are a function of changes in the hydrostatic pressure of the molten metal head 19. As the molten metal head 19 increases in height either due to an increase in the height of the upper surface 23 or to a lowering of the solidification front 24 or both, there is an increase in hydrostatic pressure. This hydrostatic pressure increase would normally increase the diameter of the resultant ingot C. However, the control system 18 is effective to counteract this increase in hydrostatic pressure by increasing the current applied to the inductor 11. These changes occur very rapidly, in fractions of a second, so that the inductance and cross section of the ingot appear substantially constant throughout.

Normally, the molten metal flowing into the containment zone is controlled manually by a suitable valve which in copper alloy casting practice is located at the top of the down spout 15. For other types of metals the valve may be located in any desired location. For example, for aluminum casting the valve is normally located toward the bottom of the down spout. The particular position of the flow control valve may be selected as desired. Conventionally manual control of flow rate is performed in response to sensing the height of the molten metal in the containment zone either visually or through electrical or electroptical means as are known in the art.

It is desired in accordance with this invention, however, that the control of the flow rate be fully automated and integrated into the control of the casting system 10. Referring now to FIGS. 1 and 2, this is accomplished by providing a flow control valve 27 somewhere in the molten metal distribution system which leads to the mold. Preferably, it is in the down spout 16. The flow control valve 27 shown comprises a pin 28 having a conical end 29 which is arranged to control the flow rate of metal from the trough 15 into the down spout 16. The pin 28 is arranged coaxially above the down spout 16. Raising the pin 28 increases the flow rate. Lowering the pin 28 decreases the flow rate. Lowering the pin 28 into contact with the end corners of the down spout 16 cuts off flow entirely.

Movement of the valve pin 28 up or down in accordance with this invention is fully automated by means of a suitable actuator 30 which can be controlled electrically. The actuator 30 shown in FIGS. 1 and 2 comprises a pneumatic actuator. The pneumatic actuator 30 includes a housing 31 internally of which is supported a flexible diaphragm 32. The diaphragm 32 in turn is connected to the valve pin 28 by means of a rod 33. The valve pin 28 is normally biased to its closed position by means of a spring 34 extending between the pin 28 and the housing 31 of the pneumatic actuator 30. Air is introduced or withdrawn from the housing 31 by a voltage to pressure transducer 35. The magnitude of the air pressure applied by the transducer 35 to the housing 31 via conduit 36 is directly proportional to the magnitude of the control voltage signal V input to the transducer 35. Variations in the signal V cause corresponding variation in the output pressure of the transducer 35. A suitable transducer 35 comprises a Model T5100 series manufactured by Fairchild, Inc. of North Carolina.

The air pressure from the transducer 35 deflects the diaphragm 32 as shown in phantom in proportion to the magnitude of the air pressure. This causes the pin 28 to be raised from its fully-closed position. The position of the pin 28 is, therefore, a function of the pressure on the lower side of the diaphragm 32. As the pressure increases, the deflection of the diaphragm 32 increases and, therefore, the flow opening into the casting zone is increased. Similarly, as the pressure decreases, the flow opening is decreased.

The transducer 35 receives the input control signal from the flow control system 37 which is connected to the power source 17 and control system 18 of the casting apparatus 10. The flow control system 37 is best shown in FIG. 2. It comprises a set point control amplifier 38, one input 39 of which is connected to a variable voltage source 40 which is utilized to set the control point of the amplifier 38. The other input 41 to the amplifier is connected to receive the desired signal A, B, or O as described above, which is sensed from within the control and excitation system 17, 18 of the inductor 11. The sensed signal A, B, or O, which is applied to the control input 41 of the amplifier is compared by the amplifier to the variable voltage source set point signal P to generate the output signal V which is proportional to the difference therebetween. The output signal V from the amplifier 38 causes the transducer 35 to increase or decrease the deflection of the diaphragm 32 to correspondingly increase or decrease the flow rate of metal from the trough 15 into the down spout 16.

The flow control system 37 preferably is of the proportional type wherein the differential between the set point signal P and the input signal A, B, or O from the control system and power source 17 and 18 is measured and amplified by a desired factor. The controller 37 preferably includes a reset function which serves to long term average the sensed signal A, B, or O. In this way, the flow control system 37 will comprise an integrating control arrangement wherein the flow rate change cycles are from 2 to 10 times the cycle time associated with the power supply control system 18. For example, the flow rate change cycles will range in time in seconds rather than in fractions of a second, preferably 2 to 10 seconds.

If the casting apparatus 10 is to be one which may be subject to drastic changes in flow rate, then the controller 37 preferably also includes a rate function which is particularly useful at start-up. The rate function of the controller 37 adds a factor to the control output signal V which would be a function of the rate of change in the input error signal A, B, or O.

The specific details of the controller 37 do not form part of the present invention, and any desired set point controller 37 which is adapted to receive the sensed hydrostatic pressure error signal A, B, or O and compare it with a predetermined value thereof to generate an error signal for controlling the transducer 35 could be used.

Figure 3:
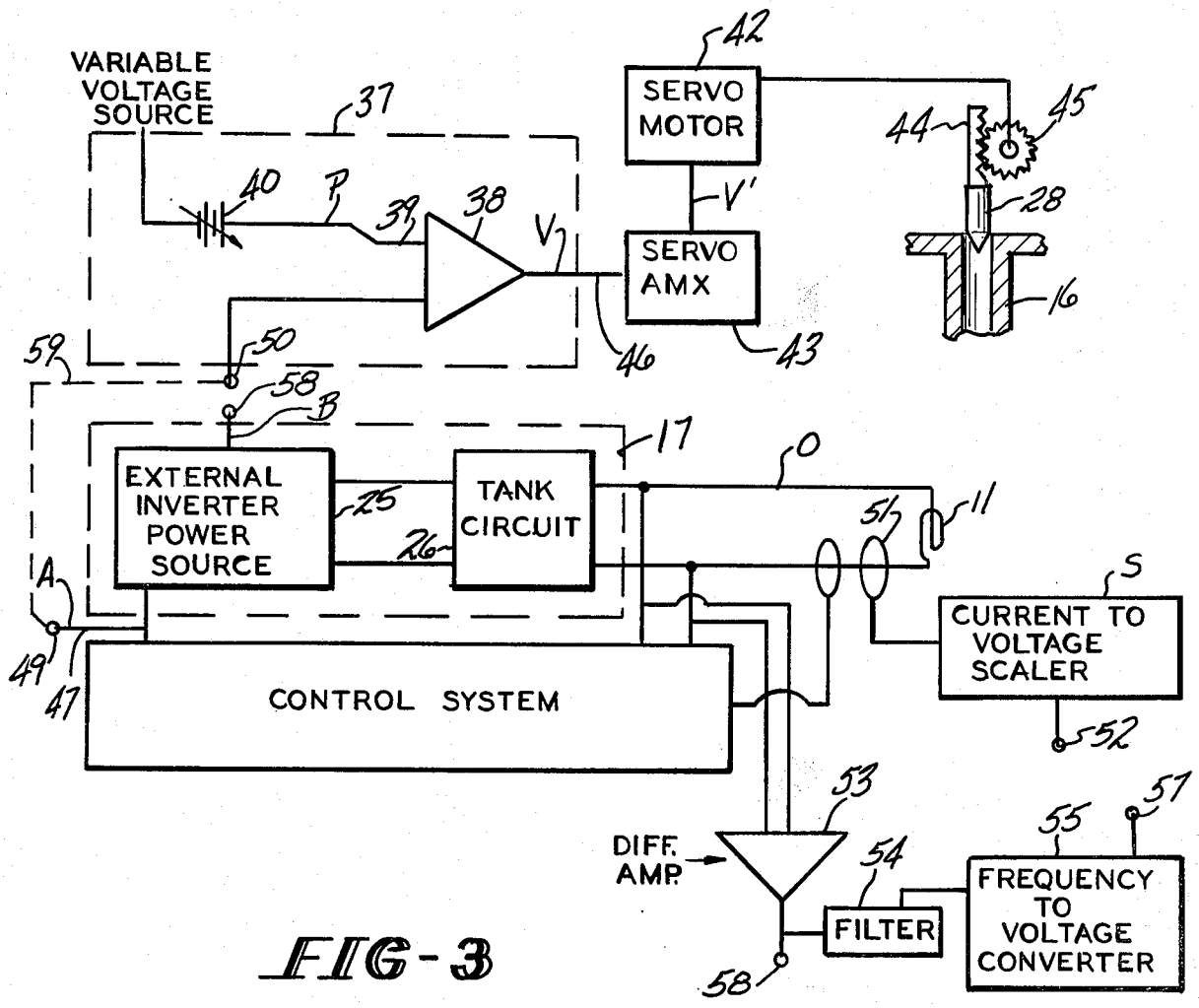
FIG. 3 is a partial schematic representation of an electromagnetic casting apparatus showing an alternative hydrostatic pressure control system.

It is not necessary in accordance with this invention to utilize a pneumatic actuator 30. It would be fully appropriate to use in place thereof either a stepping motor or a servo control motor 42 as in FIG. 3 and in place of the transducer 35, an appropriate servo amplifier 43 which would receive the error signal V from the set point amplifier 38. The pin type flow control valve 27 is arranged for movement in a frame not shown vertically and axially of the down spout 16. A rack 44 is connected to the pin 28 and is associated with a pinion gear 45 which is driven by the servo motor 42 which in accordance with this embodiment could be either a servo motor or a stepping motor. The servo motor 42 is actuated by the output signal V' from the servo amplifier 43 in response to the error signal V from the set point amplifier which is applied at the input 46 to the servo amplifier.

Accordingly, it is a unique aspect of this invention that a hydrostatic pressure change signal A, B, or O from the control and excitation system 17 and 18 for the inductor 11 is utilized to control the flow rate of the molten metal into the containment zone of the casting machine 10. The signals A, B, or O which are sensed in accordance with this invention can be sensed in any desired conventional fashion. For example, as shown in FIG. 2, the error signal A from the control system 18 can be sensed by a parallel connection 47 to the output 48 of the control system 18 so that the output 48 thereof is applied to both the power supply 17 and the flow rate controller by suitably connecting terminal 49 to terminal 50 as by a wire 59 shown in phantom.

If the current in the inductor 11 is to be sensed, this can be accomplished through the use of a current transformer 51 whose output is current to voltage scaled at S to provide a corresponding voltage signal at terminal 52 which is connected to terminal 50.

The voltage or frequency across the inductor could be sensed by means of a differential amplifier 53, filter 54 and frequency to voltage converter 55 as described in U.S. Pat. No. 4,161,206. In this approach the differential amplifier 53 is utilized to provide a voltage across the inductor 11 signal at terminal 56. The output of the differential amplifier 53 alternatively is fed to a filter circuit 54 for extracting the fundamental frequency. The output of the filter 54 is fed to a frequency to voltage converter 55. The output signal of the frequency to voltage converter 55 at terminal 57 comprises a signal proportional to the frequency of the applied current. Hydrostatic pressure control signals B from within the power source 17 such as the control bus voltage are provided at terminal 58. In practice selectively only one of the control signals A, B, or O is connected to terminal 50 as by a wire connecting that terminal to any of the signal terminals 49, 56, 57, and 58. A suitable wire connection 59 is shown in phantom connecting terminals 49 and 50 as an example.

The means for sensing the signals A, B, or O referred to above can be any desired means including a volt meter, a current meter or any other suitable instrument.

In operation the apparatus 10 of the present invention will sense changes in the hydrostatic pressure of the molten metal head 19. If the magnitude of the hydrostatic pressure change signal A, B, or O increases or decreases with time, depending on whether the hydrostatic pressure is increasing or decreasing, then the set point control amplifier 38 will provide an appropriate control signal V for controlling the actuator 30 of the flow control valve 27. If for example there is an increase in hydrostatic pressure associated with an increased flow of molten metal into the containment zone, the effect on the control system 18 for the inductor 11 would be to increase the current to overcome the higher hydrostatic pressure. This current increase would be sensed at any of the points as described above, either as the current output signal O itself or some other corresponding signal which could be traced all the way back to the change signal A which caused the increased current. The change signal A, B, or O is applied to the set point control amplifier 38 to generate an output signal V from the amplifier which would cause the flow control valve 37 to reduce the flow of molten metal into the mold. This in turn would reduce the hydrostatic pressure and cause the control system 18 for the power supply 17 to reduce the current in the inductor. This would result in a change signal A, B, or O which would be fed back to the flow control system 37 and the two systems 18 and 37 will interact until a quiescent or near quiescent condition is obtained. If some change in the flow of molten metal into the mold destroys this quiescence, then the same control interaction will occur again until a more quiescent condition is achieved.

Of course, it is recognized that the control system 18 for the power supply 17 is reacting or cycling in fractions of a second whereas the control system 37 for the molten metal flow rate is reacting or cycling in seconds. In this way it is possible to control the flow rate into the casting zone in such a manner as to have the control system for the power supply operate within its optimum range of control. The net result of the dual control of both the output of the power supply 17 and the flow rate of molten metal into the mold fully automatically as described should be to provide cast ingots of even more uniform cross section than would be obtained by the use of a control system 18 of the Yarwood et al. patent or other system alone.

In the figures common elements have the same reference numbers.

The flow control 37 could be similar to the Model 7355 three mode proportioning controllers manufactured by Honeywell, Inc., Minneapolis, Minn.

While the casting as described above has been described as an ingot, it could comprise any desired type of continuously or semi-continuously cast shape, such as rods, bars, etc. While the invention has been described by reference to copper and copper base alloys, it is believed that the apparatus and process described above can be applied to a wide range of metals and alloys including nickel and nickel alloys, steel and steel alloys, aluminum and aluminum alloys, etc. While the control circuitry has been described in an anolog format, it should be apparent that digital circuitry could be substituted including the use of appropriate microprocessing as desired.

Instead of controlling the flow of molten metal into the mold by means of a valve 27 in the downspout 16 the valve 27 could be located in the trough 15 though this is deemed less desirable. Further, in place of a valve 27 the pour rate of the furnace which provides the molten metal can be controlled by any desired means.

For example, if a conventional tilt type furnace is utilized the rate at which the furnace is tilted could be controlled in a manner similar to the way the valve 27 in the embodiments described above is controlled. This approach again is not preferred because it is too far upstream of the mold. Ideally, the valve should be located as far downstream in the distribution system as possible in order to reduce the time interval necessary to change the rate of flow of molten metal into the mold.

The terms molten metal flow or flow rate as used herein refer to the volumetric flow rate of the molten metal.

The U.S. patents set forth in this application and in particular U.S. Pat. No. 4,161,206 are intended to be incorporated by reference herein.

It is apparent that there has been provided in accordance with this invention on electromagnetic casting process and apparatus which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for casting materials comprising:

means for electromagnetically forming molten material into a desired casting shape, said electromagnetic forming means including: an inductor for applying a magnetic field to said molten material, said magnetic field defining a containment zone for said molten material and a gap between said molten material and said inductor; and means for controlling and applying an alternating current to said inductor to generate said magnetic field and minimize variations in said gap; the improvement wherein said apparatus further comprises:

means operative conjointly with said means for controlling and applying said alternating current for controlling the hydrostatic pressure exerted by said molten material in said containment zone, said hydrostatic pressure control means comprising:

means for sensing an electrical signal derived from said means for controlling and applying said alternating current, said electrical signal being one which changes in correspondence about to changes in said hydrostatic pressure of said molten material, said electrical signal comprising an error signal used to regulate the output of said means for controlling and applying said alternating current or a signal which varies in correspondence to said error signal; and means responsive to said sensed electrical signal for controlling the amount of said molten material in said containment zone so as to maintain said hydrostatic pressure within desired limits.

2. An apparatus as in claim 1 wherein said control means controls said amount of said molten material in a manner so as to provide a substantially uniform hydrostatic pressure.

3. An apparatus as in claim 1 wherein said sensed electrical signal comprises at least one of current, voltage or frequency signals applied to said inductor.

4. An apparatus as in claim 3 wherein said sensed electrical signal comprises the current in said inductor.

5. An apparatus as in claim 1 wherein said means responsive to said sensed electrical signal comprising:

control circuit means for receiving said sensed electrical signal and for generating a desired corresponding output signal; and means operable in response to said output signal of said control circuit means for increasing or decreasing the amount of molten material in said containment zone.

6. An apparatus as in claim 5 wherein said means for increasing or decreasing said flow of molten material into said containment zone comprises a valve means arranged in a molten material distribution means for transporting said molten material to said containment zone; and means for actuating said valve means to increase or decrease said molten material flow and wherein said molten material comprises a metal.

7. An apparatus as in claim 6 wherein said valve means is arranged to control the flow of molten material in a downspout of said distribution means.

8. An apparatus as in claim 7 wherein said valve means comprises a valve member arranged for movement axially of said downspout and wherein said actuating means is operatively connected to move said valve member axially of said downspout to increase or decrease said molten metal flow.

9. An apparatus as in claim 8 wherein said actuating means includes: pneumatic means for moving said valve member axially of said downspout; and transducer means for receiving said output signal and for generating a pneumatic output for application to said pneumatic means for moving said valve member, said pneumatic output being proportional to said output signal.

10. An apparatus as in claim 9 wherein said transducer means comprises a voltage to pressure transducer and wherein said output signal comprises a voltage signal and wherein said means for moving said valve member comprises; a housing including a flexible diaphragm internally thereof defining within said housing a pressure chamber, said pneumatic output from said transducer means being connected to said chamber; and said diaphragm being connected to said valve member.

11. An apparatus as in claim 8 wherein said actuating means includes:

means for moving said valve member axially of said downspount, said moving means comprising a servo or stepping motor; and means for controlling said servo or stepping motor in correspondence to said output signal.

12. An apparatus as in claim 5 wherein said control circuit means comprises a proportional controller.

13. An apparatus as in claim 12 wherein said proportional controller includes a set point function and a rate function.

14. An apparatus as in claim 5 wherein said means for controlling and applying said alternating current to said inductor includes means for determining about a reactive parameter of said inductor and for comparing said reactive parameter to a predetermined value thereof for generating an error signal, said error signal being utilized to control the output of said means for applying said alternating current; and wherein said error signal comprises said sensed electrical signal for controlling said flow of molten material into said containment zone.

15. In a process for casting materials comprising:

electromagnetically forming molten material into a desired casting shape, said electromagnetic forming step including providing an inductor for applying a magnetic field to said molten material, said magnetic field defining a containment zone for said molten material and a gap between said molten material and said inductor; and controlling and applying an alternating current to said inductor to generate said magnetic field and minimize variations in said gap; the improvement wherein said process further comprises:

controlling the hydrostatic pressure exerted by said molten material in said containment zone conjointly with said step of controlling and applying said alternating current to said inductor, said hydrostatic pressure controlling step comprising:

sensing an electrical signal derived from said step of controlling and applying said alternating current, said electrical signal being one which changes in correspondence about to changes in said hydrostatic pressure of said molten material, said electrical signal comprising an error signal used to regulate the output of said means for controlling and applying said alternating current or a signal which varies in correspondence to said error signal; and responsive to said sensed electrical signal, controlling the amount of said molten material in said containment zone so as to maintain said hydrostatic pressure within desired limits.

16. A process as in claim 15 wherein said controlling of said amount of said molten material is in a manner so as to provide a substantially uniform hydrostatic pressure.

17. A process as in claim 16 wherein said sensed electrical signal comprises at least one of current, voltage or frequency signals applied to said inductor.

18. A process as in claim 17 wherein said sensed electrical signal comprises the current in said inductor.

19. A process as in claim 16 wherein said molten material comprises a metal and wherein said step of controlling the amount of said molten metal comprises controlling the flow of said molten metal and wherein said flow control step responsive to said sensed electrical signal comprises: providing a control circuit means for receiving said sensed electrical signal; generating a desired corresponding output signal from said control circuit means; and in response to said output signal from said control circuit means increasing or decreasing the flow of molten metal into said containment zone.

20. A process as in claim 19 wherein said step of controlling and applying said alternating current to said inductor includes:

determining about a reactive parameter of said inductor and comparing said reactive parameter to a predetermined value thereof for generating an error signal, said error signal being utilized to control the output of said step of applying said alternating current; and wherein said error signal comprises said sensed electrical signal for controlling said flow of molten metal into said containment zone.

* * * * *